US012121191B1

(12) United States Patent
Zhang

(10) Patent No.: US 12,121,191 B1
(45) Date of Patent: Oct. 22, 2024

(54) SKIN CLEANING DEVICE

(71) Applicant: Shenzhen Zhihui Youpin Technology Co., LTD, Shenzhen (CN)

(72) Inventor: Jianru Zhang, Shenzhen (CN)

( * ) Notice: Subject to any disclaimer, the term of this patent is extended or adjusted under 35 U.S.C. 154(b) by 0 days.

(21) Appl. No.: 18/762,080

(22) Filed: Jul. 2, 2024

(30) Foreign Application Priority Data

Jan. 17, 2024 (CN) ..... 202420115865.1

(51) Int. Cl.
*A47K 7/04* (2006.01)

(52) U.S. Cl.
CPC ..... *A47K 7/043* (2013.01)

(58) Field of Classification Search
CPC ..... A46B 2200/102; A46B 2200/103; A46B 13/008; A46B 13/02; A46B 13/04; A46B 15/0075; A47K 7/04; A47K 7/043
USPC ..... 15/28
See application file for complete search history.

(56) References Cited

FOREIGN PATENT DOCUMENTS

KR 101956878 B1 * 6/2019 ..... A46B 13/02

* cited by examiner

*Primary Examiner* — Eric J Rosen
*Assistant Examiner* — Aaron R McConnell
(74) *Attorney, Agent, or Firm* — Daniel M. Cohn; Howard M. Cohn

(57) ABSTRACT

The present disclosure provides a skin cleaning device, comprising a cleaning assembly, the cleaning assembly comprises a silicone sleeve, a foaming silicone brush, a fixed silicone brush, a rotating silicone brush, a rotating seat, a driving seat, three foaming protrusions, a driving shaft, a mounting seat, a cross block, a driving motor, a cross groove and an inner shell. The present invention adds facial cleanser to the surface of the rotating silicone brush, drives the driving shaft to rotate through the cooperation of the driving motor, the cross block and the cross groove, and the driving shaft drives the foaming protrusions and the rotating seat to rotate respectively through the driving seat. When the foaming protrusions rotate, they rub against the foaming silicone brush and move the foaming silicone brush, so that facial cleanser generates fine cleaning foam after friction between the foaming silicone brush and the foaming protrusions.

10 Claims, 8 Drawing Sheets

SKIN CLEANING DEVICE

TECHNICAL FIELD

The present disclosure relates to a technical field of facial cleaning appliances, and in particular to a skin cleaning device.

BACKGROUND

A skin cleaning device is an instrument used to deeply cleanse the skin. It can remove dirt, oil, dead skin cells, etc. on the skin surface through different technologies and principles, thereby improving the appearance and texture of the skin, replacing the traditional way of cleaning facial skin by hand.

Currently, skin cleansing devices mainly cleanse the face through vibration massage. The brush head of the cleansing device can produce tiny vibrations and impacts through high-frequency vibrations, thereby effectively loosening and removing impurities such as dirt, oil, dead skin cells on the skin surface, without causing excessive irritation and damage to the skin.

Existing skin cleansing devices still have some limitations at the technical level. One important technical problem is that the cleaning method is single, it is difficult to simulate the process of manual hand washing, and it cannot effectively cooperate with cleansing cosmetics to produce rich cleaning foam. Therefore, the cleaning effect still needs to be improved, which affects the user experience. For this reason, a skin cleansing device is proposed.

SUMMARY

The present disclosure provides a skin cleaning device to solve or alleviate the technical problems existing in the prior art and at least provide a beneficial choice.

In order to realize the above purpose, the present disclosure provides a skin cleaning device, comprising a cleaning assembly, wherein: the cleaning assembly comprises a silicone sleeve, a foaming silicone brush, a fixed silicone brush, a rotating silicone brush, a rotating seat, a driving seat, three foaming protrusions, a driving shaft, a mounting seat, a cross block, a driving motor, a cross groove and an inner shell; the silicone sleeve is sleeved on the outer wall of the inner shell, the fixed silicone brush and the foaming silicone brush are both fixedly connected to the upper part of the outer wall of the silicone sleeve at equal intervals, the foaming silicone brush and the fixed silicone brush are both ring-shaped, the rotating silicone brush is fixedly connected to the front surface of the rotating seat, the three foaming protrusions are symmetrically fixedly connected to the outer side wall of the driving seat, the driving shaft is fixedly connected to the rear surface of the driving seat, the cross groove is provided on the rear surface of the driving shaft, the cross block is fixedly connected to the output shaft of the driving motor, the rear part of the driving motor is mounted on the upper part of the inner rear wall of the inner shell, the front part of the driving motor is mounted on the rear surface of the mounting seat.

In one embodiment, the foaming silicone brush is located inside the fixed silicone brush, the driving seat is mounted on the rear surface of the rotating seat, the rotating seat is located in front of the foaming silicone brush, the driving seat is located inside the foaming silicone brush, the foaming protrusions contact the foaming silicone brush and press the foaming silicone brush.

In one embodiment, the rotating silicone brush is located inside the fixed silicone brush, the outer side wall of the cross block is slidably connected to the inner side wall of the cross groove.

In one embodiment, the front surface of the mounting seat is fixedly connected to the inner front wall of the inner shell, the driving shaft is rotatably connected to the inner shell.

In one embodiment, the cleaning assembly also comprises an eccentric wheel and a high-speed motor; the high-speed motor is fixedly connected to the upper part of the inner rear wall of the inner shell, the eccentric wheel is installed on the output shaft of the high-speed motor, and is located below the driving motor.

In one embodiment, a control assembly is installed inside the inner shell, the control assembly also comprises a control circuit board, three control buttons and a battery; the battery is installed at the lower part of the inner rear wall of the inner shell, the control circuit board is installed in the middle of the inner wall of the inner shell, three control buttons are mounted on the front surface of the control circuit board at equal intervals.

In one embodiment, the front surface of the inner shell is provided with three elastic sheets at equal intervals, the position of the elastic sheets correspond to the position of the control buttons.

In one embodiment, the front surface of the silicone sleeve is provided with three button indicating grooves at equal intervals, the position of the button indicating grooves correspond to the position of the elastic sheets.

In one embodiment, the fixed silicone brush, the foaming silicone brush and the silicone sleeve are an integrated structure, the front end of the fixed silicone brush and the front end of the rotating silicone brush are in the same plane.

In one embodiment, the elastic sheet and the inner shell are an integrated structure, and the inner shell is composed of two shell bodies clamped together.

After adopting the above technical solutions, the skin cleaning device provided by the present disclosure has beneficial effects as follows:

1. The present invention adds facial cleanser to the surface of the rotating silicone brush, and the facial cleanser flows from the rotating silicone brush to the foaming silicone brush, and the driving shaft is driven to rotate through the cooperation of the driving motor, the cross block and the cross groove. The driving shaft drives the foaming protrusions and the rotating seat to rotate respectively through the driving seat. When the foaming protrusions rotate, they rub against the foaming silicone brush and move the foaming silicone brush. Then, the facial cleanser produces fine cleaning foam after friction between the foaming silicone brush and the foaming protrusions. Then the rotating silicone brush is brought into contact with the user's facial skin to simulate the process of manual hand-rubbing and face washing, and then the facial skin can be cleaned in conjunction with the cleaning foam, improving the cleaning effect and user experience. At the same time, it realizes the integration of vibration cleaning and rotation cleaning for the first time. It has built-in dual motors, taking into account the skin-friendliness of vibration cleaning while using a rotating silicone brush for secondary deep cleaning, which greatly enhances the cleaning intensity.
2. The present invention can seal the inner shell by sleeved a silicone sleeve on the outside of the inner shell, thereby preventing external water from entering the inner shell and causing a circuit short circuit, thereby enhancing the waterproof effect of the cleaning device; and the fixed silicone brush, the foaming silicone brush and the rotating silicone brush are all made of silicone material, which can improve the cleaning effect on the user's face and reduce irritation to the user's face.

The above summary is for illustrative purposes only and is not intended to be limiting in any way. In addition to the illustrative aspects, embodiments and features described above, further aspects, embodiments and features of the present invention will be readily apparent by reference to the accompanying drawings and the following detailed description.

BRIEF DESCRIPTION OF DRAWINGS

In order to more clearly illustrate technical solutions in embodiments of the present disclosure, drawings required in description or prior art are briefly introduced below, and obviously, the drawings in the following description are merely some embodiments of the present disclosure. For a person having ordinary skill in art, other drawings may be obtained according to the drawings without creative efforts.

Figure 1:
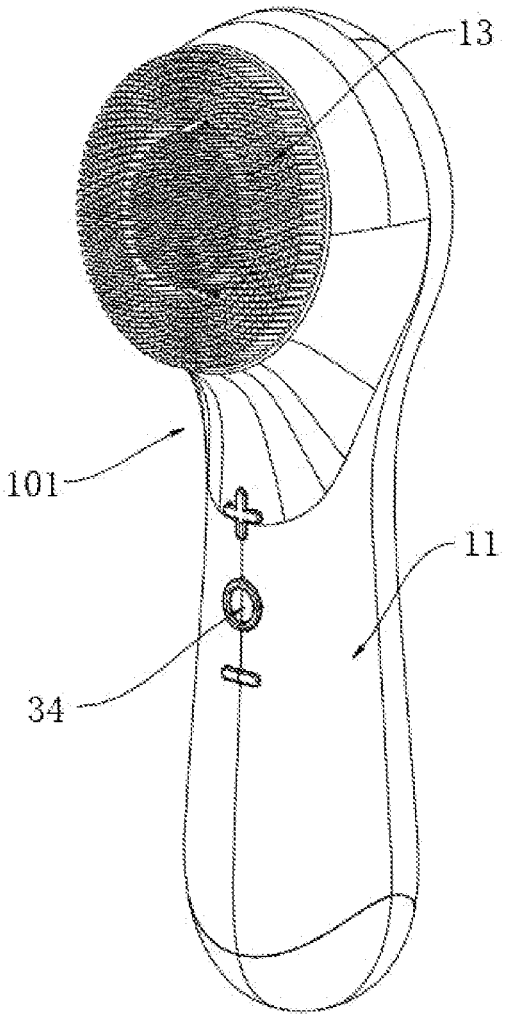
FIG. 1 is a schematic diagram of the present disclosure.

Reference number in the drawings:

| | | | |
|---|---|---|---|
| cleaning assembly | 101 | silicone sleeve | 11 |
| foaming silicone brush | 12 | fixed silicone brush | 13 |
| rotating silicone brush | 14 | rotating seat | 15 |
| driving seat | 16 | foaming protrusion | 17 |
| driving shaft | 18 | mounting seat | 19 |
| cross block | 20 | driving motor | 21 |
| cross groove | 22 | inner shell | 23 |
| eccentric wheel | 24 | high-speed motor | 25 |
| control assembly | 301 | control circuit board | 31 |
| control button | 32 | battery | 33 |
| button indicating groove | 34 | elastic sheet | 35 |

DETAILED DESCRIPTION

The following describes in detail the embodiments of the present disclosure, examples of which are illustrated in the accompanying drawings, wherein the same or similar reference numerals refer to the same or similar elements or elements having the same or similar functions throughout. The embodiments described below with reference to the accompanying drawings are exemplary, and are not intended to limit the present disclosure.

In order to make the purpose, technical solutions, and advantages of the present disclosure clear, the following further describes the present disclosure in detail with reference to accompanying drawings and embodiments.

Figure 2:
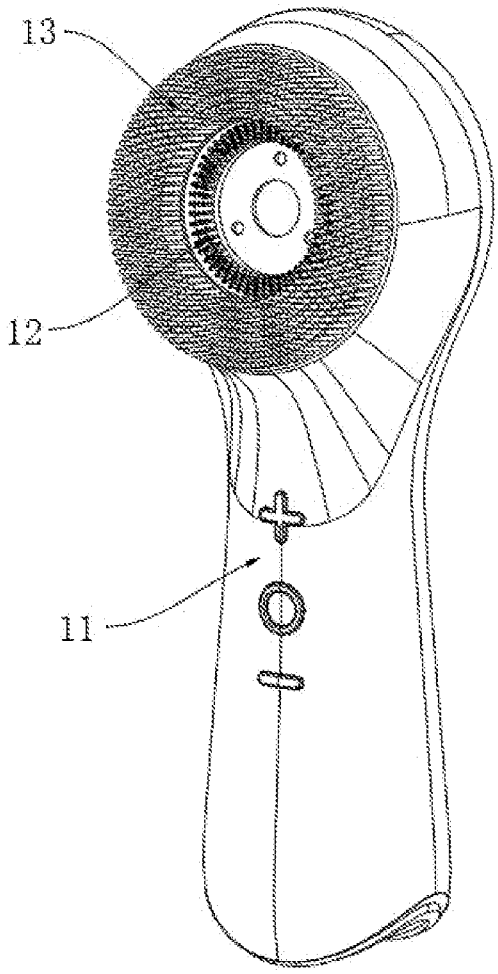
FIG. 2 is a schematic diagram of the silicone sleeve of the present disclosure.
Figure 3:
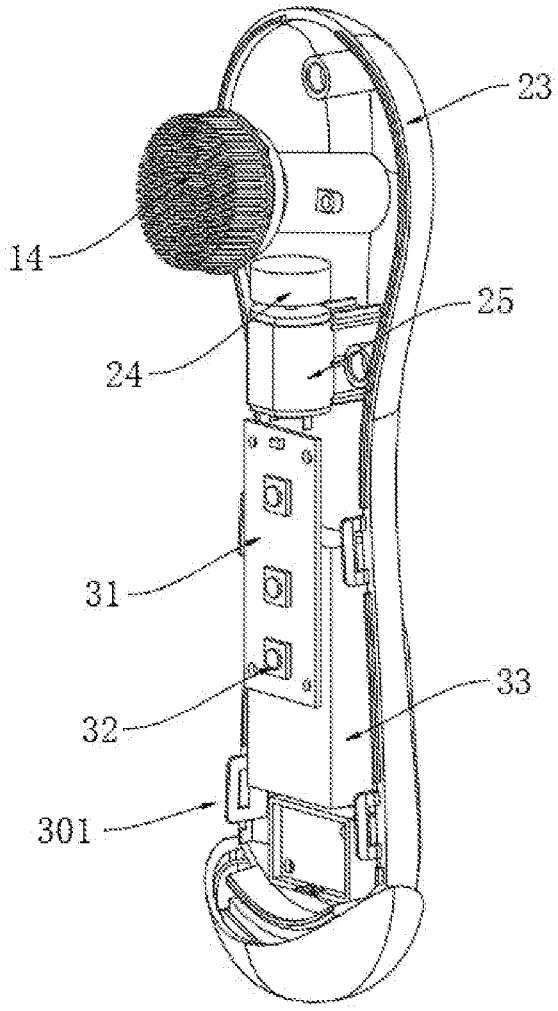
FIG. 3 is a schematic diagram of the control assembly of the present disclosure.
Figure 4:
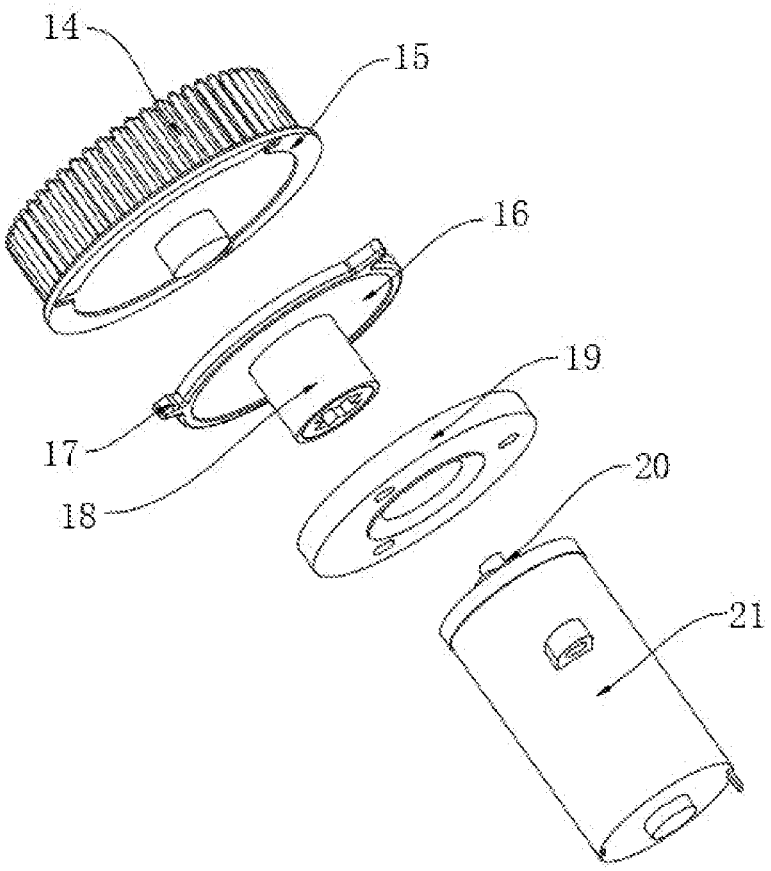
FIG. 4 is a schematic structural diagram of the driving seat of the present disclosure.
Figure 5:
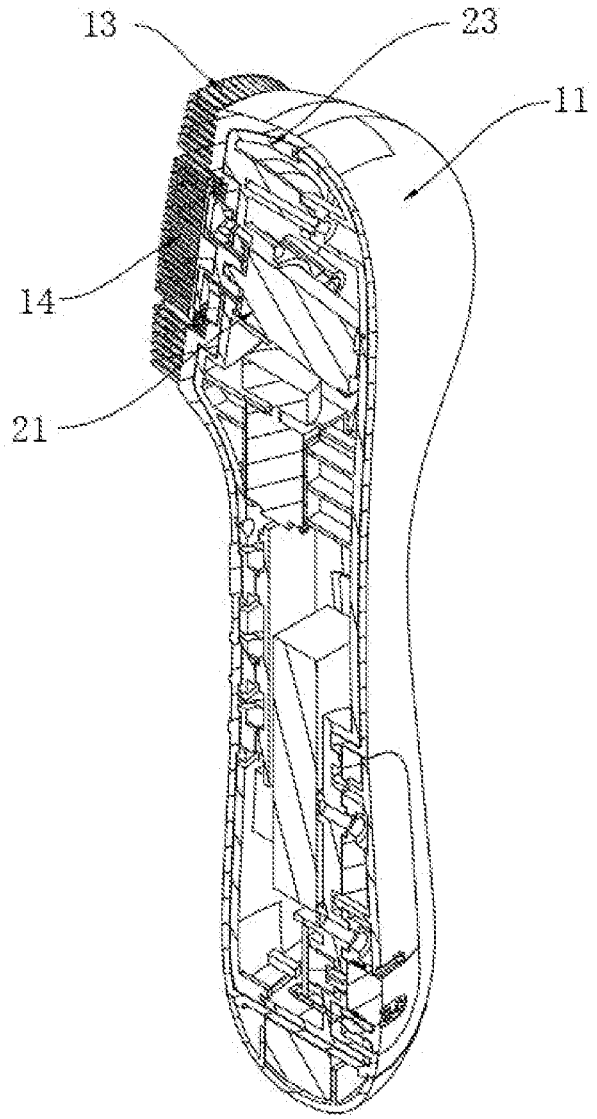
FIG. 5 is a cross-sectional view of the present disclosure.
Figure 6:
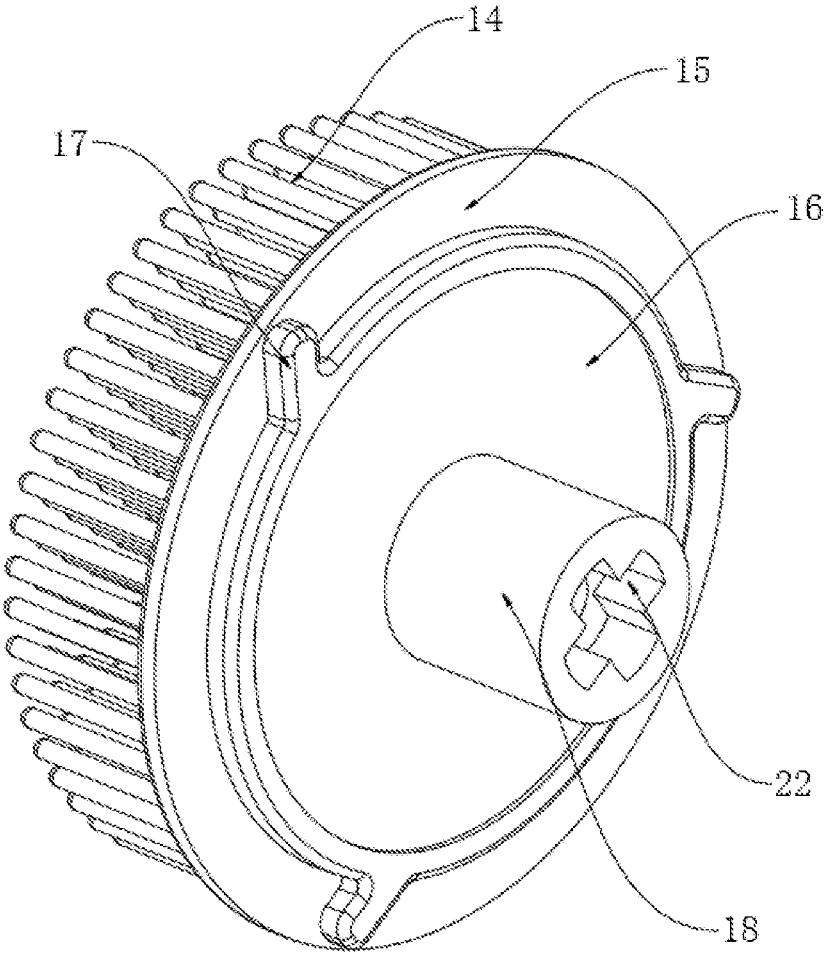
FIG. 6 is a schematic diagram of the connection between the rotating seat and the driving seat of the present disclosure.
Figure 7:
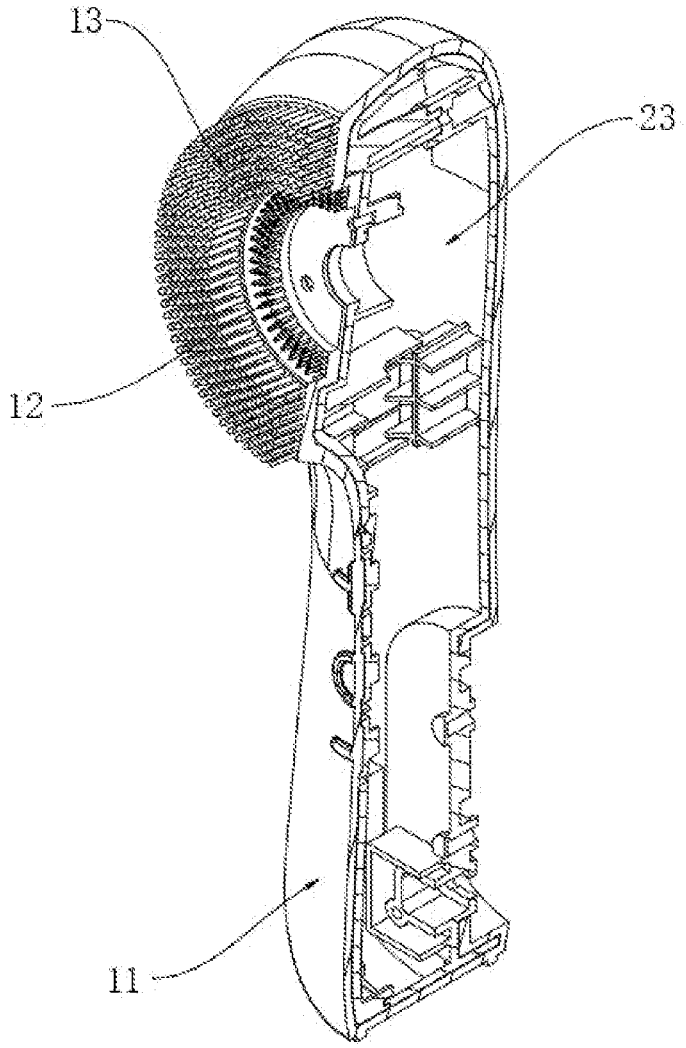
FIG. 7 is a schematic diagram of the connection between the silicone sleeve and the inner shell of the present disclosure.
Figure 8:
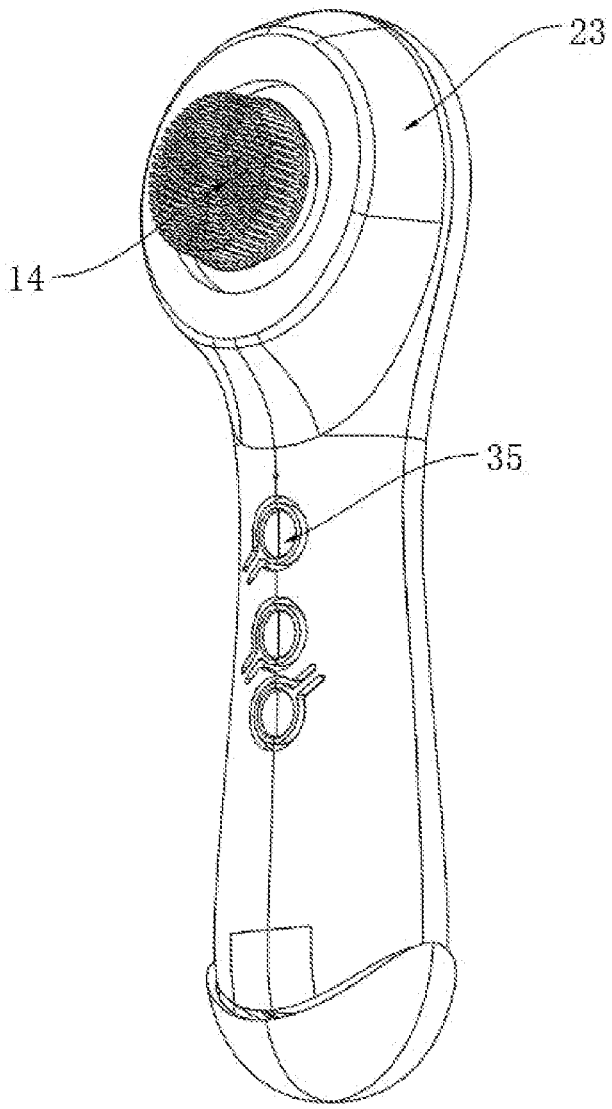
FIG. 8 a structural diagram of the inner shell of the present disclosure.

Referring to FIG. 1 to FIG. 8, the present disclosure provides a skin cleaning device, comprising a cleaning assembly 101, wherein: the cleaning assembly 101 comprises a silicone sleeve 11, a foaming silicone brush 12, a fixed silicone brush 13, a rotating silicone brush 14, a rotating seat 15, a driving seat 16, three foaming protrusions 17, a driving shaft 18, a mounting seat 19, a cross block 20, a driving motor 21, a cross groove 22 and an inner shell 23; the silicone sleeve 11 is sleeved on the outer wall of the inner shell 11, the fixed silicone brush 13 and the foaming silicone brush 12 are both fixedly connected to the upper part of the outer wall of the silicone sleeve 11 at equal intervals, the foaming silicone brush 12 and the fixed silicone brush 13 are both ring-shaped, the rotating silicone brush 14 is fixedly connected to the front surface of the rotating seat 15, the three foaming protrusions 17 are symmetrically fixedly connected to the outer side wall of the driving seat 16, the driving shaft 18 is fixedly connected to the rear surface of the driving seat 16, the cross groove 22 is provided on the rear surface of the driving shaft 18, the cross block 20 is fixedly connected to the output shaft of the driving motor 21, the rear part of the driving motor 21 is mounted on the upper part of the inner rear wall of the inner shell 23, the front part of the driving motor 21 is mounted on the rear surface of the mounting seat 19.

In one embodiment, the foaming silicone brush 12 is located inside the fixed silicone brush 13, the driving seat 16 is mounted on the rear surface of the rotating seat 15, the rotating seat 15 is located in front of the foaming silicone brush 12, the driving seat 16 is located inside the foaming silicone brush 12, the foaming protrusions 17 contact the foaming silicone brush 12 and press the foaming silicone brush 12, when the driving seat 16 rotates, the driving seat 16 drives the foaming protrusion 17 to squeeze and move the foaming silicone brush 12, and the facial cleanser in the foaming silicone brush 12 is rubbed to produce fine foam. At the same time, the driving seat 16 drives the rotating seat 15 to rotate, and the rotating seat 15 drives the rotating silicone brush 14 to rotate. The rotating silicone brush 14 simulates hand rubbing and washing the face during the rotation process, and then cleans the user's face with cleaning foam, which can improve the cleaning effect and user's experience.

In one embodiment, the rotating silicone brush 14 is located inside the fixed silicone brush 13, the outer side wall of the cross block 20 is slidably connected to the inner side wall of the cross groove 22. The cross block 20 and the cross groove 22 play a transmission role. The cross block 20 is driven by the driving motor 21, and the cross block 20 drives the driving shaft 18 through the cross groove 22, so that the rotating silicone brush 14 can be driven to clean the user's face.

In one embodiment, the front surface of the mounting seat 19 is fixedly connected to the inner front wall of the inner shell 23, the driving shaft 18 is rotatably connected to the inner shell 23. The mounting seat 19 can limit the position of the driving motor 21, thereby enhancing the stability of the structure. The driving motor 21 drives the driving shaft 18, the driving shaft 18 drives the driving seat 16, and the driving seat 16 drives the rotating silicone brush 14, which can simulate hand rubbing and washing the face during the rotation process and improve the user's experience.

In one embodiment, the cleaning assembly 101 also comprises an eccentric wheel 24 and a high-speed motor 25; the high-speed motor 25 is fixedly connected to the upper part of the inner rear wall of the inner shell 23. The eccentric wheel 24 is mounted on the output shaft of the high-speed motor 25. The eccentric wheel 24 is located below the driving motor 21. The high-speed motor 25 drives the eccentric wheel 24 to rotate at a high speed. Since the position of the high-speed motor 25 is fixed, the cleaning device vibrates with the cooperation of the high-speed motor 25 and the eccentric wheel 24. At this time, the rotating silicone brush 14 and the fixed silicone brush 13 both vibrate along with the cleaning device, thereby achieving facial cleaning through vibration massage.

In one embodiment, a control assembly 301 is installed inside the inner shell 23, the control assembly 301 also comprises a control circuit board 31, three control buttons 32 and a battery 33; the battery 33 is installed at the lower part of the inner rear wall of the inner shell 23, the control circuit board 31 is installed in the middle of the inner wall of the inner shell 23, the three control buttons 32 are mounted on the front surface of the control circuit board 31 at equal intervals. By cooperating with the control button 32 and the control circuit board 31, the driving motor 21 and the high-speed motor 25 can be controlled. When the control button 32 is pressed, the high-speed motor 25 begins to work. When the control button 32 is pressed again, the driving motor 21 and the high-speed motor 25 begin to rotate simultaneously. When the control button 32 is pressed for the third time, both the driving motor 21 and the high-speed motor 25 stop rotating.

In one embodiment, the front surface of the inner shell 23 is provided with three elastic sheets 35 at equal intervals, the position of the elastic sheets 35 correspond to the position of the control buttons 32. The front surface of the silicone sleeve 11 is provided with three button indicating grooves 34 at equal intervals, the position of the button indicating grooves 34 corresponds to the position of the elastic sheets 35. Furthermore, the inner shell 23 can be sealed by the silicone sleeve 11 to prevent external water from entering the inner shell 23 and causing a circuit short circuit, thereby enhancing the waterproof effect of the skin cleansing device.

In one embodiment, the fixed silicone brush 13, the foaming silicone brush 12 and the silicone sleeve 11 are an integrated structure, the front end of the fixed silicone brush 13 and the front end of the rotating silicone brush 14 are in the same plane. The fixed silicone brush 13 and the rotating silicone brush 14 cooperate to clean the user's face.

In one embodiment, the elastic sheet 35 and the inner shell 23 are an integrated structure, and the inner shell 23 is composed of two shell bodies clamped together, so that the inner shell 23 can be easily disassembled and repaired.

In one embodiment, the electrical output terminal of the battery 33 is electrically connected to the electrical input terminal of the control circuit board 31, the electrical output terminals of the control circuit board 31 are electrically connected to the electrical input terminals of the drive motor 21 and the high-speed motor 25 respectively.

When the present invention is working, the corresponding control button 32 is pressed through the button indicating grooves 34 on the silicone sleeve 11, and the control button 32 controls the high-speed motor 25 to work, and the high-speed motor 25 drives the eccentric wheel 24 to rotate at a high speed. Since the position of the high-speed motor 25 is fixed, the cleaning device vibrates under the cooperation of the high-speed motor 25 and the eccentric wheel 24. At this time, facial cleaning can be achieved by vibration massage. By adding facial cleanser to the rotating silicone brush 14, the facial cleanser flows from the rotating silicone brush 14 to the foaming silicone brush 12, and then the control button 32 is pressed again, and the control button 32 controls the driving motor 21 to work. At this time, the driving motor 21 drives the driving shaft 18 to rotate through the cooperation of the cross block 20 and the cross groove 22, and the driving shaft 18 drives the driving seat 16 to rotate, and the driving seat 16 drives the foaming protrusions 17 and the rotating seat 15 to rotate respectively. When the foaming protrusions 17 rotate, they rub against the foaming silicone brush 12 and move the foaming silicone brush 12, and then the facial cleanser produces fine cleaning foam after the friction between the foaming silicone brush 12 and the foaming protrusions 17. Then, the rotating silicone brush 14 is brought into contact with the user's facial skin. Since the rotating silicone brush 14 is made of silicone, after the rotating silicone brush 14 is brought into contact with the user's face, it can simulate the process of manually rubbing the face, and then the facial skin can be cleaned with the cleaning foam. At the same time, it realizes the integration of vibration cleaning and rotation cleaning for the first time. It has built-in dual motors, takes into account the skin-friendliness of vibration cleaning and uses a rotating silicone brush 14 for secondary deep cleaning, which greatly enhances the cleaning intensity.

Above are only preferred embodiments of the present disclosure and are not intended to limit the present disclosure. Any modification, equivalent replacement and improvement made within spirit and principle of the present disclosure should be comprised in protective scope of the present disclosure.

What is claimed is:

1. A skin cleaning device, comprising a cleaning assembly, wherein: the cleaning assembly comprises a silicone sleeve, a foaming silicone brush, a fixed silicone brush, a rotating silicone brush, a rotating seat, a driving seat, three foaming protrusions, a driving shaft, a mounting seat, a cross block, a driving motor, a cross groove and an inner shell; the silicone sleeve is sleeved on the outer wall of the inner shell, the fixed silicone brush and the foaming silicone brush are both fixedly connected to the upper part of the outer wall of the silicone sleeve at equal intervals, the foaming silicone brush and the fixed silicone brush are both ring-shaped, the rotating silicone brush is fixedly connected to the front surface of the rotating seat, the three foaming protrusions are symmetrically fixedly connected to the outer side wall of the driving seat, the driving shaft is fixedly connected to the rear surface of the driving seat, the cross groove is provided on the rear surface of the driving shaft, the cross block is fixedly connected to an output shaft of the driving motor, the rear part of the driving motor is mounted on the upper part of the inner rear wall of the inner shell, the front part of the driving motor is mounted on the rear surface of the mounting seat.

2. The skin cleaning device of claim 1, wherein the foaming silicone brush is located inside the fixed silicone brush, the driving seat is mounted on the rear surface of the rotating seat, the rotating seat is located in front of the foaming silicone brush, the driving seat is located inside the foaming silicone brush, the foaming protrusions contact the foaming silicone brush and press the foaming silicone brush.

3. The skin cleaning device of claim 2, wherein the rotating silicone brush is located inside the fixed silicone brush, the outer side wall of the cross block is slidably connected to the inner side wall of the cross groove.

4. The skin cleaning device of claim 1, wherein the front surface of the mounting seat is fixedly connected to the inner front wall of the inner shell, the driving shaft is rotatably connected to the inner shell.

5. The skin cleaning device of claim 1, wherein the cleaning assembly also comprises an eccentric wheel and a high-speed motor; the high-speed motor is fixedly connected to the upper part of the inner rear wall of the inner shell, the eccentric wheel is installed on the output shaft of the high-speed motor, and is located below the driving motor.

6. The skin cleaning device of claim 5, wherein a control assembly is installed inside the inner shell, the control assembly also comprises a control circuit board, three control buttons and a battery; the battery is installed at the lower part of the inner rear wall of the inner shell, the control circuit board is installed in the middle of the inner wall of the inner shell, the three control buttons are equidistantly mounted on the front surface of the control circuit board.

7. The skin cleaning device of claim 6, wherein the front surface of the inner shell is provided with three elastic sheets at equal intervals, the position of the elastic sheets correspond to the position of the control buttons.

8. The skin cleaning device of claim 7, wherein the front surface of the silicone sleeve is provided with three button indicating grooves at equal intervals, the position of the button indicating grooves correspond to the position of the elastic sheets.

9. The skin cleaning device of claim 8, wherein the fixed silicone brush, the foaming silicone brush and the silicone sleeve are an integrated structure, the front end of the fixed silicone brush and the front end of the rotating silicone brush are in the same plane.

10. The skin cleaning device of claim 8, wherein the elastic sheet and the inner shell are an integrated structure, and the inner shell is composed of two shell bodies clamped together.

* * * * *